US007143670B2

(12) United States Patent
Geary

(10) Patent No.: US 7,143,670 B2
(45) Date of Patent: Dec. 5, 2006

(54) COMPACT AUXILIARY POSITIONING DRIVER FOR WRENCH

(75) Inventor: Ronald J. Geary, Bradenville, PA (US)

(73) Assignee: Kennametal Inc., Latrobe, PA (US)

( * ) Notice: Subject to any disclaimer, the term of this patent is extended or adjusted under 35 U.S.C. 154(b) by 6 days.

(21) Appl. No.: 11/071,028

(22) Filed: Mar. 3, 2005

(65) Prior Publication Data

US 2006/0196323 A1 Sep. 7, 2006

(51) Int. Cl.
*B25B 13/46* (2006.01)
*B25B 13/48* (2006.01)

(52) U.S. Cl. ..... 81/180.1; 81/177.2

(58) Field of Classification Search ..... 81/180.1, 81/177.2, 177.85

See application file for complete search history.

(56) References Cited

U.S. PATENT DOCUMENTS 5,361,656 A * 11/1994 Starr ..... 81/180.1
5,485,769 A * 1/1996 Olson et al. ..... 81/177.85
5,509,333 A * 4/1996 Rion ..... 81/180.1
6,647,831 B1 * 11/2003 Hu ..... 81/60
2004/0159193 A1 * 8/2004 Lin ..... 81/180.1
2005/0284269 A1 * 12/2005 Hung ..... 81/180.1

* cited by examiner

*Primary Examiner*—David B. Thomas
(74) *Attorney, Agent, or Firm*—Larry R. Meenan

(57) ABSTRACT

A torque wrench having structure for facilitating manual rotation of the rotatable output shaft, for rotating the output shaft to an effective angular position which enables an internal ratchet mechanism to operate effectively. This structure preferably is a knurled thumbwheel which slip fits over the output shaft, which is preferably a removable bit. The wrench includes a handle, socket for receiving a bit, and an internal ratchet. The bit is configured to drivably engage the thumbwheel, and to present a non-circular distal terminal for engaging and driving a fastener. Optionally, the thumbwheel is removably secured to the bit by friction fit or in other ways.

10 Claims, 2 Drawing Sheets

COMPACT AUXILIARY POSITIONING DRIVER FOR WRENCH

FIELD OF THE INVENTION

The present invention relates to cutting tools. More particularly, the present invention relates to an improvement enabling rotation of a wrench in greatly confined areas.

BACKGROUND OF THE INVENTION

Some cutters in the field of machine tools must be placed within a machine tool under highly confined areas and subsequently tightened. In particular, so-called quick change micro tooling has been designed for use in Swiss style turning centers, lathes, and screw machines. Representative examples are seen in the products of Kennametal, Inc. of Latrobe, Pa. Such products typically include a tool holder and an associated clamping unit which is held to the tool holder by a screw. The clamping unit is preferably tightened to a predetermined range of torque values. This is done by driving a screw which is accessible from the tool holder. In Swiss style turning centers and other machines, this can be difficult when using conventional torque wrenches, as clearances where the cutter is installed may possibly be insufficient to rotate the torque wrench by its conventional lever or arm handle. What may occur is that rotation of the relatively long handle is limited to the point that the arc of rotation of the handle is insufficient to enable the pawl to move to the next ratchet tooth of the wrench. All known procedures for overcoming a torque wrench thus disabled necessarily incur penalties of time of the operating personnel. Similar problems may bedevil larger machines. There exists a need to overcome inability of a wrench handle to move an internal pawl to the next ratchet position.

SUMMARY OF THE INVENTION

The present invention improves long handled wrenches by providing a compact driver at the bit rotated by the wrench. The driver is greater in diameter than the driven bit, and smaller than the rotational radius than the wrench handle. In a preferred embodiment, the driver comprises a thumbwheel drivingly disposed about the bit.

The thumbwheel is readily grasped and rotated by hand or finger, such that the wrench may be held in place engaging the screw or other fastener being tightened. The thumbwheel is manually rotated until the pawl engages the next ratchet tooth. At this point, the conventional handle may be brought to bear in imposing desired torque to the fastener. Necessity of removing the wrench or otherwise disturbing the cutting tool is eliminated. A quick manual adjustment enables torquing to proceed expeditiously.

A significant advantage of the present invention is that a small or miniature torque wrench may be operated entirely by one hand. For example, the handle may be held in the palm while the thumb and forefinger turn the thumbwheel. This is in addition to overcoming the problem of limited handle rotation which defeats pawl operation.

BRIEF DESCRIPTION OF THE DRAWINGS

Further features of the present invention, as well as the advantages derived therefrom, will become clear from the following detailed description made with reference to the drawings in which.

DESCRIPTION OF THE PREFERRED EMBODIMENTS

Figure 1:
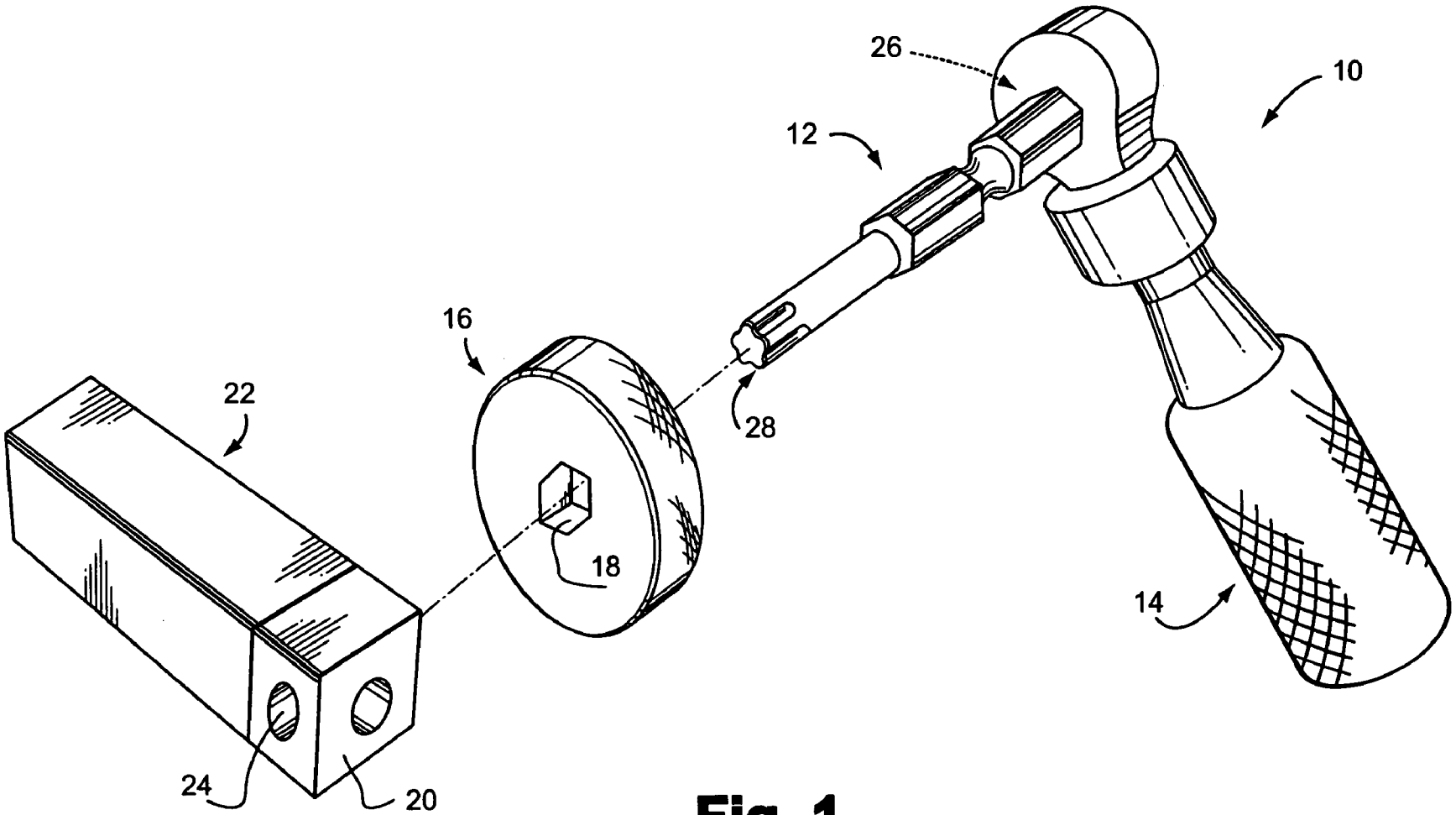
FIG. 1 is an exploded perspective view of one embodiment of a wrench incorporating the present invention.

FIG. 1 of the drawings shows in exploded form a representative torque wrench 10 having a drive bit 12 connected thereto. Drive bit 12 is one form of a rotatable output element which may be rotated by torque wrench 10. Torque wrench 10 may be, for example, a wrench such as model number TWT256R which is commercially available from Kennametal Inc., of Latrobe, Pa. The invention may also be used with other wrenches, for example, of a type (not shown) bearing a female socket into which a drive bit may be integral. Regardless of the particular type of wrench, it will either have integrally formed therewith a rotatable output element such as drive bit 12, or alternatively will accept connection of a bit such as drive bit 12 or other driving device. Also regardless of the particular type of wrench, it will have a drive handle disposed to exert leverage on and to rotate the rotatable output element. Preferably, the wrench is a torque wrench capable of indicating particular values of torque being applied to the drive bit or other rotatable output element, or may instead or in addition have elements for limiting maximum applied torque to a predetermined value.

Torque wrench 10 has a handle 14 disposed to exert leverage on and to rotate drive bit 12 when grasped and wielded by hand. Handle 14 is preferably an arm which projects radially away from the rotatable output element or shaft. As depicted, drive bit 12 is a splined drive such as those by the brand name Torx RTM , although of course, the drive terminal may be of any desired configuration.

A knurled disc 16 bearing a hexagonal central bore 18 cooperates with drive bit 12 in the following way. Central bore 18 has a configuration cooperating with that of the exterior surface of drive bit 12. Central bore 18 is dimensioned and configured to fit in close cooperation with drive bit 12 such that when knurled disc 16 is rotated, then drive bit 12 is also rotated.

Figure 2:
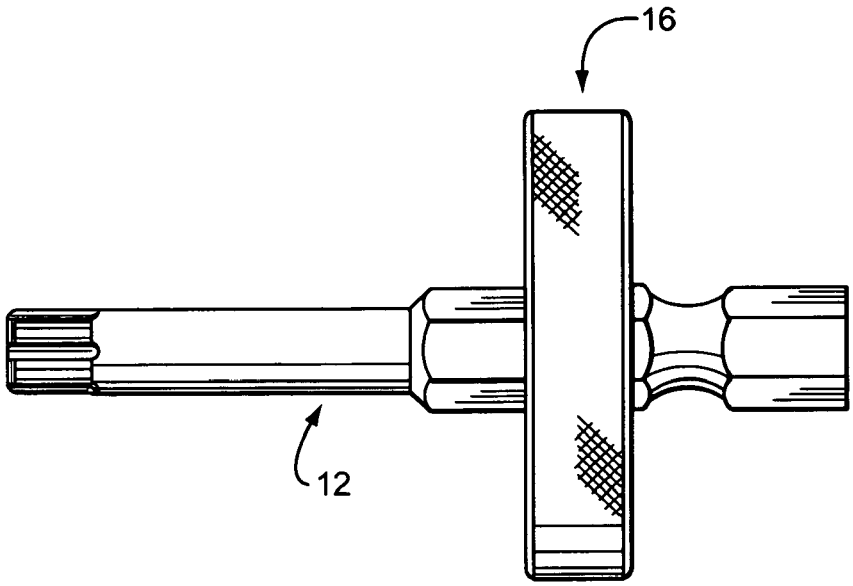
FIG. 2 is a side elevational view of the driver bit shown in FIG. 1, shown assembled to a drive element in the form of a knurled disc, the latter also shown in FIG. 1.

Drive bit 12 is intended to tighten and loosen the screw (not shown) of a clamping mechanism 20 of a tool holder 22. Drive bit 12 engages a screw accessible from an access bore 24 formed in tool holder 22. It is contemplated that toolholder 22 is a miniature tool holder such as of the Kennametal micro toolholder series used in a machine tool such as, for example, a Swiss style turning center among others, where access and working clearances are severely limited to the point that it may not be possible to rotate drive bit 12 by rotating handle 14 sufficiently to advance an internal ratchet mechanism (not visible in FIG. 1) to the point that wrench 10 can be effectively deployed. Referring momentarily to FIG. 2, when knurled disc 16 is installed on drive bit 12, drive bit 12 can be rotated manually by grasping and rotating knurled disc 16, thereby overcoming inability to rotate handle 14 of wrench 10. Once a pawl of the internal ratchet of wrench 10 advances to a new ratchet tooth, drive bit 12 may be effectively rotated by using handle 14.

Knurled disc 16 provides one form of an arrangement for enhancing manual rotatability of a rotatable output shaft such as drive bit 12. The arrangement includes a manual drive element such as disc 16 disposed at the output shaft (e.g., drive bit 12) and disposed to enable ready rotation of the output shaft by manual effort imposed directly on the drive element. This arrangement enables the rotatable output element to be rotated manually without wielding handle 14.

Figure 3:
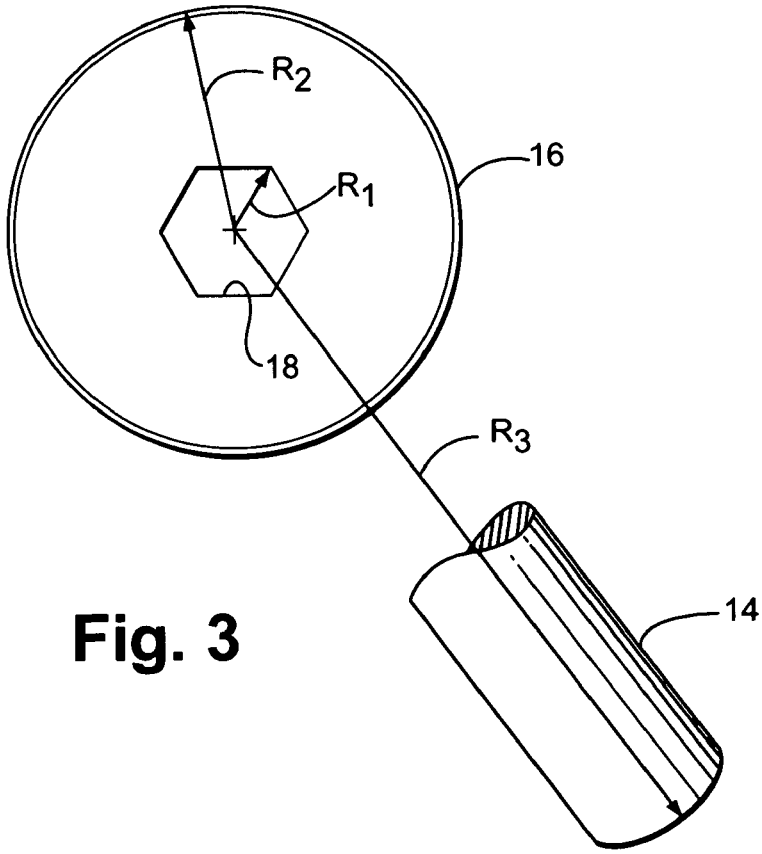
FIG. 3 is an end elevational view of the knurled disc of FIGS. 1 and 2, including a fragmentary showing of the handle of the associated wrench.

Referring now to FIG. 3, the important feature of the drive element (e.g., disc 16) is that it has an effective drive radius $R_1$ greater than the radius $R_2$ of the rotatable output shaft, but less than the drive radius $R_3$ of drive handle 14. These relationships enable disc 16 to facilitate manual rotation of drive bit 12 while fitting into quarters too tight to receive handle 14. While the drive element preferably assumes the configuration of a disc or some other circular shape, other configurations could be used if desired. The central opening or bore 18 of disc 16 may be of any configuration which will drivingly engage drive bit 12 when disc 16 is installed on drive bit 12 and rotated.

In the embodiment depicted, bit 12 has a shaft which is hexagonal along at least part of its length. Similarly, central bore 18 is hexagonal. Of course, other non-circular cooperating configurations could be employed.

Disc 16 preferably engages the hexagonal portion of drive bit 12 by loose friction fit such that disc 16 can be manually slipped over and installed on drive bit 12, but resists spontaneous disengagement therefrom, or otherwise is disposed to removably engage drive bit 12. Alternatively, disc 16 may be permanently affixed to drive bit 12 by bonding or by integral construction.

In the preferred embodiments, wrench 10 provides a rotatable socket 26 with which drive bit 12 removably cooperates and interfits. It would be possible to utilize a wrench (not shown) wherein a rotatable output element corresponding to bit 12 is integral with the wrench.

It will be recognized that the wrench may have either a female drive member for receiving a driven output shaft such as shaft, or alternatively may have a male driven output shaft terminating in a driving terminal or terminating in an end which drivably receives a driving element such as, for example, a multi-point socket. Similarly, the driving terminal of the rotatable output element may be a polyhedron, may be splined, may be a specially configured drive 28, as depicted herein such as Torx RTM, straight slot, cruciform, or of any other configuration.

It will also be appreciated that the rotatable output element may be integral with the wrench, in the sense of permanently fixed thereto, such as by integral initial fabrication, by welding, by an adhesive such as, for example, a hardenable methacrylate substance. Alternatively, the rotatable output element may be removably secured within wrench, such as by spring biased ball detent, friction fit, setscrew, clip, or in any other suitable manner.

While the invention has been specifically described in connection with certain specific embodiments thereof, it is to be understood that this is by way of illustration and not of limitation, and the scope of the appended claims should be construed as broadly as the prior art will permit.

What is claimed is:

1. A wrench having a rotatable output element, a drive handle disposed to exert leverage on and to rotate the rotatable output element, a rotatable socket that connects the drive handle to the rotatable output element, and an arrangement for enhancing manual rotatability of the rotatable output element, the arrangement comprising a manual drive element disposed about the rotatable output element at a location spaced from the rotatable socket and disposed to enable ready rotation of the rotatable output element by manual effort imposed directly on the drive element, whereby the rotatable output element may be rotated manually without wielding the drive handle, wherein the manual drive element having an effective drive radius greater than the radius of the rotatable output element and lesser than the radius of the drive handle.

2. The wrench according to claim 1, wherein side drive handle comprises an arm projecting radially away from the rotatable output element.

3. The wrench according to claim 1, wherein the rotatable output element comprises a bit.

4. The wrench according to claim 1, wherein the drive element assumes configuration of a disc.

5. The wrench according to claim 4, wherein the disc has a central opening dimensioned and configured to drivingly engage the rotatable output element.

6. The wrench according to claim 5, wherein the rotatable output element has a hexagonal shaft and the central opening of the disc is hexagonal.

7. The wrench according to claim 1, wherein the wrench has a rotatable socket, and the rotatable output element removably cooperates with and interfits with the rotatable socket.

8. The wrench according to claim 1, wherein the drive element is disposed to removably engage the rotatable output element.

9. The wrench according to claim 1, wherein the rotatable output element is permanently affixed to the wrench.

10. A ratcheting wrench comprising:

a rotatable output element having two ends distally located on a polyhedral shaft, a driving handle having a rotatable socket attached to one end of the polyhedral shaft to exert leverage on the wrench, a manual drive element removably disposed about the polyhedral shaft and positioned so that a gap is present between manual drive element and the driving handle, wherein the manual drive element is disposed to enable ready rotation of the rotatable output element by manual effort imposed directly on the manual drive element, wherein the manual drive element has an effective drive radius greater than the radius of the rotatable socket and lesser than the radius of the drive handle.

* * * * *